United States Patent [19]

Komada et al.

[11] 4,448,168

[45] May 15, 1984

[54] FUEL INJECTION SYSTEM

[75] Inventors: Hideaki Komada; Yutaka Kojima; Tomonori Ohie, all of Matsuyama, Japan

[73] Assignee: Diesel Kiki Company, Ltd., Tokyo, Japan

[21] Appl. No.: 399,514

[22] Filed: Jul. 19, 1982

[30] Foreign Application Priority Data

Jul. 30, 1981 [JP] Japan ..... 56-119734

[51] Int. Cl.[3] ..... F02M 51/00

[52] U.S. Cl. ..... 123/446; 123/447; 123/467; 123/458; 239/88

[58] Field of Search ..... 123/446, 447, 445, 500, 123/501, 467, 458; 239/88, 89, 90, 91, 92, 93, 94, 95, 585, 533.1–533.15; 417/392, 401

[56] References Cited

U.S. PATENT DOCUMENTS

| | | | |
|---|---|---|---|
| 3,943,901 | 3/1976 | Takahashi | 123/467 |
| 4,069,800 | 1/1978 | Kanada | 123/447 |
| 4,279,385 | 7/1981 | Straubel | 239/88 |
| 4,280,464 | 7/1981 | Kanai | 123/447 |
| 4,359,032 | 11/1982 | Ohie | 123/467 |
| 4,381,750 | 5/1983 | Funada | 123/446 |
| 4,418,671 | 12/1983 | Kelso | 123/458 |

*Primary Examiner*—Charles J. Myhre
*Assistant Examiner*—Carl Stuart Miller
*Attorney, Agent, or Firm*—David G. Alexander

[57] ABSTRACT

A fuel injector of a Diesel engine is supplied with a boosted supply of fuel from a booster and operated to start and terminate a fuel injection by a hydraulically controlled nozzle needle actuator. A valving unit is controlled to selectively communicate compressed operating fluid to the booster so that the boosted supply of fuel reaches the fuel injector. The valving unit comprises a pair of poppet type valves each of which is operated by a solenoid operated pilot valve, thereby attaining high speed operation due to a high frequency of switching actions and accommodating a large flow rate of fluid. A manually or automatically adjustable stop is associated with each of the poppet type valves to control the flow rate of fluid through the valve to the booster, which dictates the pressure of fuel injection from the injector.

6 Claims, 3 Drawing Figures

FUEL INJECTION SYSTEM

BACKGROUND OF THE INVENTION

The present invention generally relates to fuel injection systems for Diesel engines and, more particularly, to a fuel injection system of the type which includes a booster for boosting the pressure of fuel to be supplied to a fuel injector and a nozzle needle actuator for controlling a fuel injection by the fuel injector in response to a control of a hydraulic fluid pressure applied thereto.

A prior art fuel injection system of the type described includes a fuel reservoir, and a booster operated by a pressure differential between opposite ends thereof to compress fuel fed from the fuel reservoir to one end thereof. The fuel develops a first hydraulic fluid pressure. A fuel injector injects a supply of compressed fuel fed from the booster. A nozzle needle actuator is operatively associated with the fuel injector and operated by a pressure differential between opposite ends thereof to start and terminate a fuel injection from the fuel injector. The supply of compressed fuel from the booster is also fed to one end of the nozzle needle actuator to develop the first hydraulic fluid pressure. A first hydraulic circuit means produces a variable hydraulic fluid pressure and is communicated with a hydraulic fluid reservoir. The variable hydraulic fluid pressure is fed to the other end of the booster through a first direction control means as a second hydraulic fluid pressure. The other end of the nozzle needle actuator is communicated by a second hydraulic circuit means to the fluid reservoir and the first hydraulic circuit means or second hydraulic fluid pressure through a second direction control means. A control means controls the second hydraulic fluid pressure in the first hydraulic circuit means and the states of the first and second direction control means.

This type of fuel injection system, however, involves a problem due to the use of a solenoid operated direction control valve as the second direction control means which selectively communicates said other end of the booster to the fluid reservoir and a pump associated therewith. The solenoid operated direction control valve is of the ordinary type in which a spool disposed in a valve body is caused into a stroke to switch the flow passage from one to the other. The maximum switching rate available with such a valve is not more than five times per second and the buildup characteristic is poor. Therefore, the prior art system cannot speed up its operation beyond a limit determined by the valve.

Another inherent drawback of the spool type valve is that the structure is not suitable for accommodating a large flow rate of fluid.

SUMMARY OF THE INVENTION

A fuel injection system embodying the present invention includes a booster for compressing at one end thereof a supply of fuel pumped from a fuel reservoir, a fuel injector supplied with the compressed fuel from the booster to start and terminate a fuel injection at controlled timings, a fluid reservoir storing operating hydraulic fluid substantially under atmospheric pressure, and a pump for compressing the operating fluid by sucking it from the field reservoir. A valving means operates the booster by selectively communicating the other end of the booster to the fluid pressure in the reservoir and the delivery pressure of the pump. The valving means is controlled by a control means in response to a varying operating condition of an engine with which the fuel injection system is associated. The valving means comprises a poppet type valve formed with a first port communicating to said other end of the booster, a second port communicating to the delivery pressure of the pump and a third port communicating to the fluid pressure in the fluid reservoir through a pilot valve. A valve member is slidably received in the valve and formed with a restriction passageway therethrough which provides communication between the second and third ports. A second poppet type valve is formed with a first port communicating to said other end of the booster, a second port communicating to the fluid pressure in the reservoir, and a third port communicating to the fluid pressure in the reservoir through a second pilot valve. A valve member is slidably received in the second poppet type valve and formed with a restriction passageway which communicates the first and third ports of the valve to each other.

In accordance with the present invention, a fuel injector of a Diesel engine is supplied with a boosted supply of fuel from a booster and operated to start and terminate a fuel injection by a hydraulically controlled nozzle needle actuator. A valving unit is controlled to selectively communicate compressed operating fluid to the booster so that the boosted supply of fuel reaches the fuel injector. The valving unit comprises a pair of poppet type valves each of which is operated by a solenoid operated pilot valve, thereby attaining high speed operation due to a high frequency of switching actions and accommodating a large flow rate of fluid. A manually or automatically adjustable stop is associated with each of the poppet type valves to control the flow rate of fluid through the valve to the booster, which dictates the pressure of fuel injection from the injector.

It is an object of the present invention to provide a fuel injection system of the type described which is capable of high speed operation and accommodate a large flow rate of operating fluid.

It is another object of the present invention to provide a fuel injection system of the type described which is furnished with a unique valving unit to permit the fuel injection pressure to be adjusted either manually or automatically.

It is another object of the present invention to provide a generally improved fuel injection system of the type described.

Other objects, together with the foregoing, are attained in the embodiment described in the following description and illustrated in the accompanying drawings.

DESCRIPTION OF THE PREFERRED EMBODIMENT

While the fuel injection system of the present invention is susceptible of numerous physical embodiments, depending upon the environment and requirements of use, substantial numbers of the herein shown and described embodiment have been made, tested and used, and all have performed in an eminently satisfactory manner.

Figure 1:
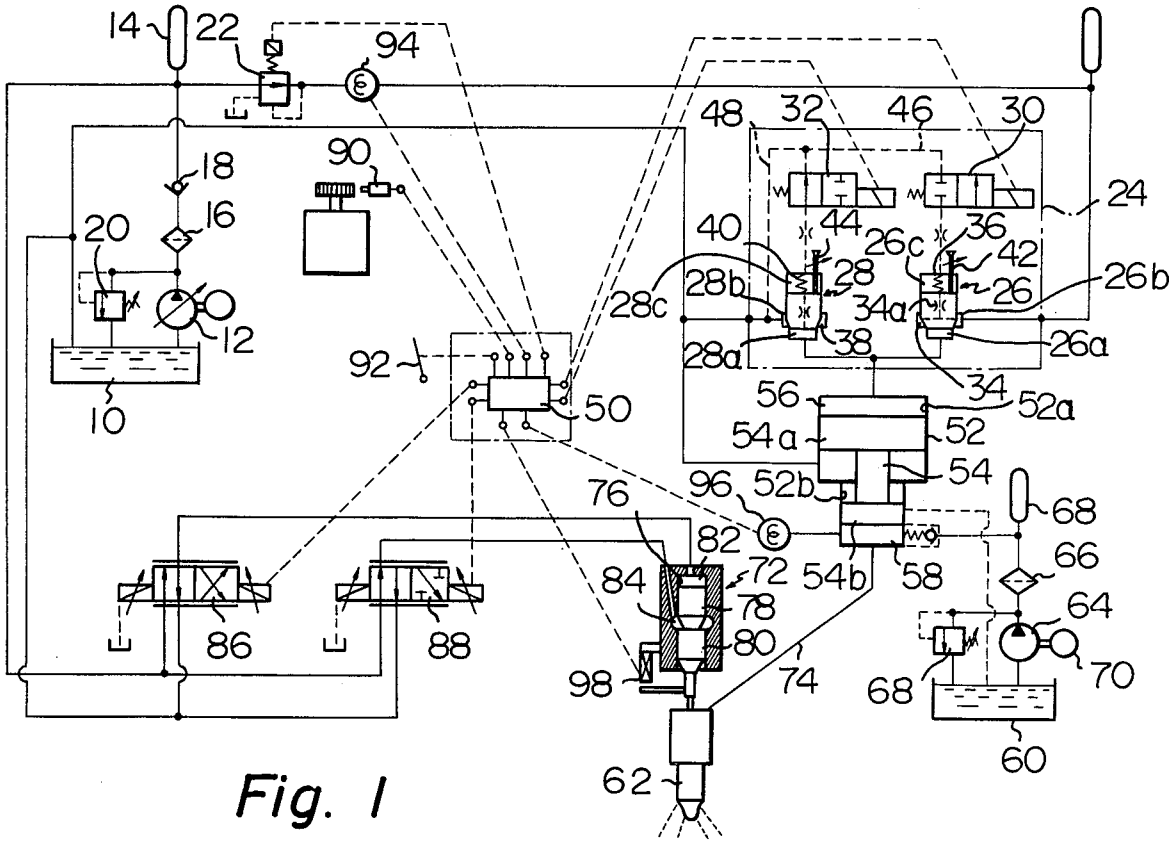
FIG. 1 is a schematic view of a fuel injection system embodying the present invention.

Referring to FIG. 1 of the drawings, the fuel injection system includes a source of hydraulic fluid supply or reservoir 10 which stores operating hydraulic fluid substantially under atmospheric pressure. A pump 12 compresses the operating fluid from the reservoir 10 and feeds it to an accumulator 14 through a filter 16 and a check valve 18. A relief valve 20 returns an excessive part of the delivery from the pump 12 to the reservoir 10. The compressed fluid is supplied through a solenoid operated pressure regulator 22 to a valving unit which constitutes one of characteristic features of the present invention and is generally designated by the reference numeral 24.

The valving unit 24 is made up of a pair of poppet type valves 26 and 28 and a pair of pilot valves 30 and 32 adapted to operate the valves 26 and 28, respectively. The valve 26 has an end port 26*a*, a side port 26*b* and a pilot port 26*c*. The operating fluid from the pump 12 is communicated to the side port 26*b* of the valve 26. A valve member 34 is slidably received in the valve 26 and backed by a spring 36 which exerts a relatively small magnitude of force. When engaged with a seat of the valve 26, the valve member 34 interrupts the communication between the end port 26*a* and the side port 26*b*. A restriction passageway 34*a* extends through the valve member 34 to provide communication between the side port 26*b* and the pilot port 26*c*. Likewise, the valve 28 is formed with an end port 28*a*, a side port 28*b* and a pilot port 28*c*. The side port 28*b* is communicated with the reservoir 10. A valve member 38 is slidable within the valve 28 and backed by a spring 40 into contact with a seat of the valve 28, thereby normally discommunicating the end port 28*a* from the side port 28*b*. The force of the spring 40 is as weak as the force of the spring 36. A restriction passageway 38*a* extends through the valve member 38 to allow the end port 28*a* and pilot port 28*c* to remain in mutual communication. Stops 42 and 44 are controllably coupled in the valves 26 and 28, respectively, to make the stroke or lift of the associated valve member adjustable.

Pilot passageways 46 and 48 branch off a line (unnumbered) connecting the side port 28*b* of the valve 28 to the reservoir 10 and terminate individually at the pilot ports 26*c* and 28*c*. The pilot valves 30 and 32, which are commonly of the high speed, solenoid operated type, are positioned in the pilot passageways 46 and 48, respectively. Thus, the communication of each end port 26*c* or 28*c* with the reservoir 10 is controlled depending on the position of the corresponding pilot valve 30 or 32. This is effected by a control unit 50 which will be described later in detail.

When the pilot valve 30 is opened and the pilot valve 32 closed, the pilot port 26*c* of the valve 26 is brought into communication with the reservoir 10 and thereby depressurized. Then, the valve member 34 is moved against the spring 36 by the operating fluid under pressure communicated to the side port 26*b*. Meanwhile, the valve member 38 of the valve 38 remains closed due to the closed position of the pilot valve 32. The operating fluid, therefore, is allowed to flow from the side port 26*b* to the end port 26*a* of the valve 26. In the other situation wherein the pilot valve 30 is closed and the pilot valve 32 opened, the valve 26 is closed to interrupt the communication between the side port 26*b* and the end port 26*a*, while the valve 28 is opened to set up the communication between the side port 28*b* and the end port 28*a*.

The end ports 26*a* and 28*a* join each other and are commonly communicated to a booster generally designated by the reference numeral 52.

The booster 52 comprises intercommunicated upper and lower bores 52*a* and 52*b*. The upper bore 52*a* is larger in diameter than the lower bore 52*b*. A servo piston 54 is slidably disposed in the upper and lower intercommunicated bores 52*a* and 52*b* and has an upper piston 54*a* and a lower piston 54*b* which correspond in diameter to the upper and lower bores 52*a* and 52*b*, respectively. The upper piston 54*a* defines a piston chamber 56 thereabove, while the lower piston 54*b* defines a compression chamber 58 therebelow. The end ports 26*a* and 28*a* of the valves 26 and 28 are communicated with the piston chamber 56 of the booster 52. The compression chamber 58 has communication with a source of fuel supply or fuel reservoir 60 and a fuel injection nozzle or fuel injector 62.

The fuel reservoir 60 connects to a pump 64 which in turn connects to the compression chamber 58 of the booster 52 through a filter 66 and an accumulator 68. A relief valve 68 is communicated with the delivery side of the pump 64 to maintain the delivery pressure at a controllable level. The pump 64 is driven by a drive 70 to suck and compress fuel from the fuel reservoir 60. The compressed fuel is supplied to the compression chamber 58 of the booster 52 while being accumulated in the accumulator 68.

Though not shown in the drawing, the fuel injector 62 has in its body a nozzle needle which is normally operated by a nozzle needle actuator 72 to close nozzle holes in contact with a seat. A supply of compressed fuel from the booster 52 is communicated to a fuel well formed inside the nozzle body via a conduit 74.

The nozzle needle actuator 72 has an axial bore 76 in which a first piston 78 and a second piston 80 are received one above the other. The first piston 78 defines a chamber 82 thereabove. The end of the upper piston 78 adjacent to the lower piston 80 is tapered to define an annular chamber 84. The chamber 82 is communicable either with the reservoir 10 or with the delivery side of the pump 16 through a first servo valve 86. Likewise, the annular chamber 84 is communicable with the reservoir 10 or the delivery side of the pump 16 through a second servo valve 88.

The control unit 50 supplies control signals to the servo valves 86 and 88 as well as to the pilot valves 30 and 32 of the valving unit 24 and the pressure regulator 22. The control unit 50 is supplied with outputs of an engine speed sensor 90, a throttle sensor 92 responsive to a position of an accelerator pedal, pressure pickups 94 and 96 and a nozzle needle pickup 98.

In operation, the pump 12 is driven to feed compressed operating fluid which is then controlled by the relief valve 20 to a desired pressure. The pressure regulator 22 is controlled by the control unit 50 to match the fluid pressure communicated to the valving unit 24 with a load of the engine. That is, the booster 52 is operated by a fluid pressure which matches with a varying engine load.

When the control unit 50 opens the pilot valve 30 and closes the pilot valve 32, the valve 26 is opened and the valve 28 closed. Then, the operating fluid is fed under the controlled pressure into the piston chamber 56 of the booster 52 via the ports 26*b* and 26*a* of the valve 26.

While the volume of the operating fluid admitted in the piston chamber 56 depends on the opening time of the valve 26 and the fluid pressure acting on the booster 52, it can be regulated by operating the stops 42 and 44 to vary the lifts of the associated valve members 34 and 38.

Figure 2:
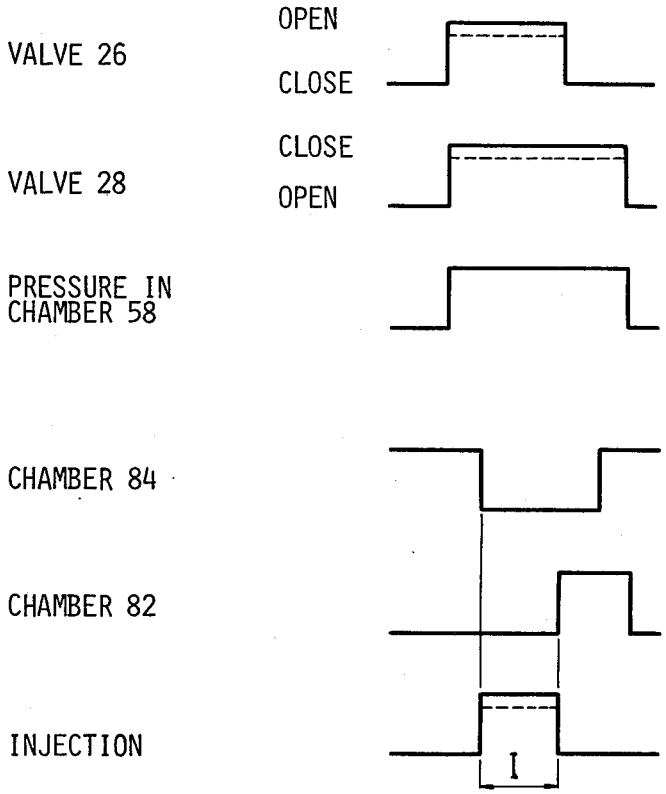
FIG. 2 is a diagram representing various operation characteristics attainable with the fuel injection system shown in FIG. 1.

The fluid pressure admitted in the piston chamber 56 moves the servo piston 54 downwardly so that the fuel in the compression chamber 58 has its pressure boosted to be forced into the fuel well of the fuel injector 62 via the conduit 74. The pressure (injection pressure) inside the fuel well is determined by the volume of pressurized fluid introduced into the piston chamber 56 of the booster, that is, it is variable in accordance with a pressure determined by the pressure regulator 22 whose operation is subordinate to a varying engine load. This pressure may have been compensated by the stops 42 and 44 which control the strokes of their associated valve members 34 and 38. The injection pressure varies in proportion to the lifts of the valve members 34 and 38 which are dictated by the stops 42 and 44, respectively. The valves 26 and 28 are caused to open and close at the timings and with the lifts shown in FIG. 2. The solid lines in FIG. 2 represent the lifts of the valves provided by the minimum stop positions of the stops 42 and 44, and the dotted lines the lifts provided by the maximum stop positions of the same. The pressure inside the compression chamber 58 builds up and down as also shown in FIG. 2 in response to such actions of the valves 26 and 28. It should be remembered, however, that the characteristics shown in FIG. 2 have neglected the injection of fuel from the fuel injector 62. Fuel is actually injected while the valve 26 is opened.

After the compressed fuel has been fed from the booster 52 to the fuel well of the fuel injector 62 as previously stated, the control unit 50 operates the servo valve 88 to set up communication of the chamber 84 of the nozzle needle actuator 72 with the reservoir 10 instead of the pump 12. This sharply reduces the pressure inside the chamber 84 down to the atmospheric level, whereby the nozzle needle of the fuel injector 62 is raised to inject the compressed fuel. In the meantime, the servo valve 86 maintains the chamber 82 in communication with the reservoir 10 and, therefore, at the low temperature. When the servo valve 86 is actuated to communicate the chamber 82 to the pump 12 with the chamber 84 communicated to the reservoir 10, the pressure in the chamber 82 is sharply raised so that the nozzle needle is caused into contact with the seat to terminate the fuel ignition. Thereafter, the servo valves 88 and 86 are repositioned to communicate the chamber 84 to the pump 12 and the chamber 82 to the reservoir 10. This brings the nozzle needle actuator 72 back to the position shown in FIG. 1 and, thus, prepares it for the next fuel injection.

For the injection control discussed above, the chambers 84 and 82 of the nozzle needle actuator 72 are pressurized and depressurized to the relation shown in FIG. 2. The resulting injection timing is indicated by "I" in FIG. 2. The solid line in FIG. 2 represents an injection pressure during a full load engine operation and the dotted line an injection pressure controlled by the pressure regulator 22 and the stops 42 and 44.

Now, reference will be made to FIG. 3 for describing a practical example of the valving unit 24.

Figure 3:
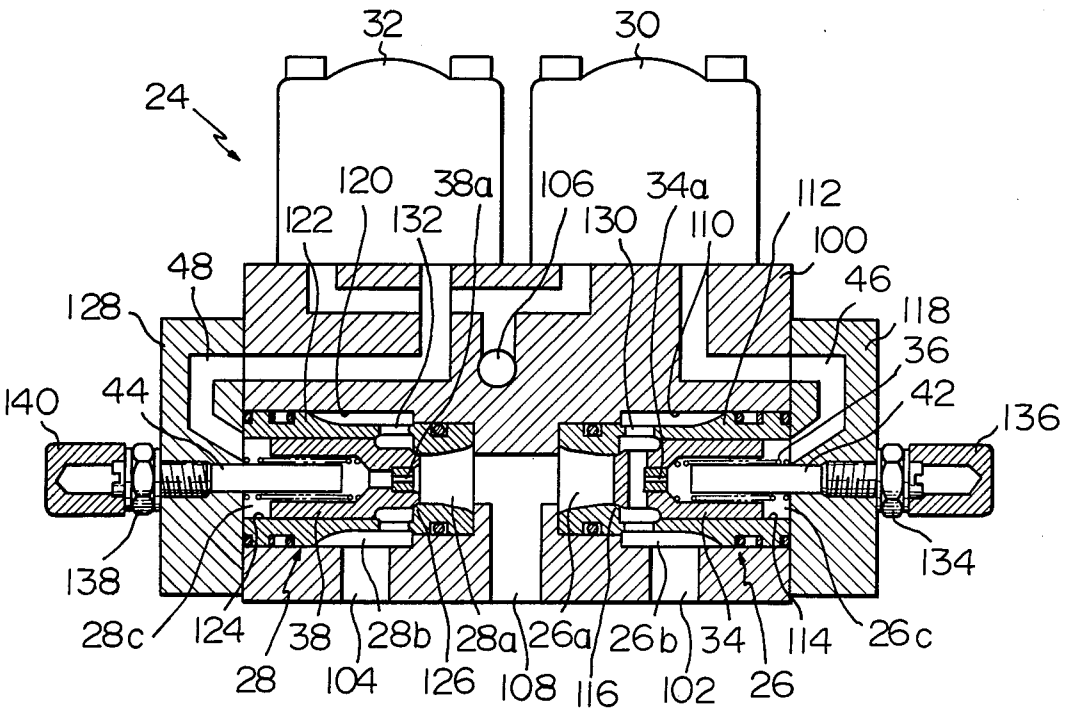
FIG. 3 is a partly elevational section of a valving unit included in the fuel injection system shown in FIG. 1.

Referring to FIG. 3, the valving unit 24 comprises a body 100 which is formed with a passageway 102 for communication with the pump 12, a passageway 104 for communication with the reservoir 10, a pilot opening 106 for communication with the reservoir 10, and a passageway 108 for communication with the piston chamber 56 of the booster 52. The pilot passageways 46 and 48 are communicated with the pilot opening 106. These passageways and opening are arranged in the manner schematically indicated in FIG. 1. The pilot valves 30 and 32 are mounted on the upper end of the valve body 100. The valve 26 operated by the pilot valve 30 is mounted in a bore 110 which is open to one side of the valve body 100. The valve 26 is of the integral cartridge type which has the valve member 34 slidably received in a sleeve 112 which is formed with a bore 114 having a valve seat 116. The spring 36 is loaded in the valve member 34 from the back and retained by a cover 118 which is mounted on the valve body 100. The construction and arrangement of the other valve 28 is common to the valve 26 except for its location in a bore 120 which is open to the opposite side of the valve member 100. A sleeve 122 having a bore 124 amd a valve seat 126 and a cover 128 are associated with the valve 28 in the same manner as in the valve 26. The valve member 34 is formed with the restriction passageway **34*a* which communicates the side port 26*b* to the pilot port 26*c*. The valve member 38 is formed with the restriction passageway 38*a* which communicates the end port 28*a* to the pilot port 28*c*. The sleeves 112 and 122 are formed with openings 130 and 132 which provide communication between the bores 114 and 124 and the side ports 26*b* and 28*b***, respectively.

The stops 42 and 44 are screwed into the covers 118 and 128, respectively. A nut 134 and a cap 136 are fitted to the outermost end of the stop 42 and a nut 138 and a cap 140 to the outermost end of the other stop 44. The stops 42 and 44 are individually rotatable to vary the lifts of the corresponding valve members 34 and 38 and, thereby, the flow rates of the operating fluid. While in the illustrated example, the stops 42 and 44 are manually adjusted to desired positions, it will be seen that they may be controllably connected with the control unit 50 to be automatically adjusted by a servo motor or like rotating means, though not shown in the drawings.

In summary, it will be seen that the present invention provides a fuel injection system having a valving unit which shows a fast response and accommodates a significant flow rate of operating fluid, due to the use of poppet type valves. It will also be seen that small and high speed pilot valves can be employed because they are disposed in pilot passageways and, therefore, need only to control a small flow rate of operating fluid. Such high speed pilot valves, coupled with the poppet type valves, facilitate quick switching actions of the latter, i.e. about twenty times per second.

Various modifications will become possible for those skilled in the art after receiving the teachings of the present disclosure without departing from the scope thereof. For example, the pressure regulator 22 may be omitted to allot the function of regulating the fuel injection pressure to the stops 42 and 44 only. In this case, the stops 42 and 44 may be actuated by a servo motor as previously mentioned in order to attain an automatic control.

What is claimed is:

1. A fuel injection system including a booster for compressing at one end thereof a supply of fuel pumped from a fuel reservoir, a fuel injector supplied with the compressed fuel from the booster to start and terminate a fuel injection at controlled timings, a fluid reservoir storing operating hydraulic fluid substantially under atmospheric pressure, and a pump for compressing the operating fluid by sucking it from the fluid reservoir, characterized by comprising:

a valving means for operating the booster by selectively communicating the other end of the booster to the fluid pressure in the fluid reservoir and the delivery pressure of the pump; and a control means for controlling the operation of the valving means in response to a varying operating condition of an engine with which the fuel injection system is associated;

the valving means comprising a poppet type valve formed with a first port communicating to said other end of the booster, a second port communicating to the delivery pressure of the pump and a third port communicating to the fluid pressure in the fluid reservoir through a pilot valve, a valve member being slidably received in said valve and formed with a restriction passageway therethrough which provides communication between the second and third ports, and a second poppet type valve formed with a first port communicating to said other end of the booster, a second port communicating to the fluid pressure in the reservoir, and third port communicating to the fluid pressure in the reservoir through a second pilot valve, a valve member being slidably received in said second poppet type valve and formed with a restriction passageway which communicates the first and third ports of the valve to each other.

2. A fuel injection system as claimed in claim 1, further comprising a pressure regulator located in a hydraulic passage between the pump and the valving means, said pressure regulator being controlled by the control means in response to the varying engine operating condition to regulate the fluid pressure selectively communicated to said other end of the booster through the valving means, thereby adjusting the pressure of fuel injection from the fuel injector.

3. A fuel injection system as claimed in claim 1, further comprising a lift adjustor means associated with each of the poppet type valves of the valving means to adjust the lift of the corresponding valve member, whereby the flow rate of the operating fluid through the valving means to the booster is adjusted to in turn adjust the pressure of fuel injection from the fuel injector.

4. A fuel injection system as claimed in claim 3, in which the lift adjustor means is manually operated.

5. A fuel injection system as claimed in claim 3, in which the lift adjustor means is operated by a rotating means which is controlled by the control means.

6. A fuel injection system as claimed in claim 5, in which the rotating means comprises a servo motor.

* * * * *